US006615414B2

(12) United States Patent
Miller et al.

(10) Patent No.: US 6,615,414 B2
(45) Date of Patent: Sep. 9, 2003

(54) PORTABLE SANITATION DEVICE

(76) Inventors: Martha C Miller, 1041 Hwy. 84 W., Thomasville, GA (US) 31792; A. Glenn Miller, Jr., 1041 Hwy. 84 W., Thomasville, GA (US) 31792

( * ) Notice: Subject to any disclaimer, the term of this patent is extended or adjusted under 35 U.S.C. 154(b) by 0 days.

(21) Appl. No.: 09/921,372

(22) Filed: Aug. 2, 2001

(65) Prior Publication Data

US 2002/0016986 A1 Feb. 14, 2002

Related U.S. Application Data

(60) Provisional application No. 60/222,629, filed on Aug. 3, 2000.

(51) Int. Cl.[7] ..... E03D 1/00
(52) U.S. Cl. ..... 4/321; 4/476
(58) Field of Search ..... 4/300, 321, 449, 4/476, 664

(56) References Cited

U.S. PATENT DOCUMENTS 2,004,933 A * 6/1935 Davison ..... 4/664 X
3,601,821 A * 8/1971 Corsiglia ..... 4/300
3,835,480 A * 9/1974 Harding
4,162,218 A * 7/1979 McCormick ..... 210/104
4,922,557 A * 5/1990 Harding et al. ..... 4/321 X
5,647,074 A * 7/1997 White et al. ..... 4/312 X

FOREIGN PATENT DOCUMENTS

GB 1180566 * 2/1970 ..... 4/664
GB 2271581 * 4/1994 ..... 4/449

* cited by examiner

*Primary Examiner*—Charles E. Phillips
(74) *Attorney, Agent, or Firm*—Carnes, Cona & Assoc.

(57) ABSTRACT

The present invention is a portable sanitation device comprising a stall that houses and maintains a conventional toilet. Coupled to the toilet is a water source and coupled to the stall is a removable and separate septic tank. The water source will render a flushable unit that permits the waste to travel from the toilet to a separate and removable septic tank. Other features can be added for enhancing the present invention, such as, but not limited to: a sink coupled to the water source; a light source interiorly and/or exteriorly located; a urinal coupled to the water source; a tissue dispensing apparatus; a soap dispenser; a vent; shower head coupled to the water source; a capacity gauge coupled to the septic tank; and a by-pass valve located within the waste line of the toilet to the septic tank for enabling capability of by-passing the septic tank and tapping into an existing sewage line.

14 Claims, 8 Drawing Sheets

PORTABLE SANITATION DEVICE

This is a utility Patent Application for Provisionally File Application No. 60/222,629 filed on Aug. 3, 2000.

BACKGROUND OF THE INVENTION

1. Field of the Invention

The present invention relates generally to a portable sanitation device and more particularly to a portable sanitation device having a water reservoir for providing a flushable unit wherein waste is contained within a removable and separate septic tank unit for inherently providing a sanitary environment.

2. Description of the Prior Art

Portable lavatories are known and used generally during large social events, such as, but not limited to sporting events, concerts, fairs, or the like, and/or during the construction or renovation of any structural unit, such as dwelling, building, road construction, or the like. These conventional portable lavatories are generally a singular stall having a holding tank under the toilet. The user utilizes the toilet and the waste is stored within the holding tank. No flushing, water, or the like is used to assist and/or guide the waste into the holding tank. Unfortunately, this as is obvious, provides for an unsanitary situation, by enabling a waste build-up to easily occur and also allowing the user to accidentally get waste on the edge of the toilet and/or floor of the portable lavatory. Vents are not used, and thus the rancid air is often overwhelming thereby resulting in a unit not fit for use.

Means of washing one's hand is also not provided with conventional portable lavatories. Thereby, enabling germs to spread easily and quickly due to this inherently unsanitary situation and environment. Further, at public events many will bring infants and toddlers, many who are not potty trained. As such, diaper changing is a must. No conventional portable lavatories offer the benefit of a diaper changing station. Thus, providing an inconvenience for parents of children still in diapers as well as inherently providing for a potentially dangerous and nonsanitary makeshift changing station for the infants and toddlers in diapers.

Accordingly, it is seen that there exists a need for tremendously improving the sanitary conditions of portable toilets and the like, as is now available and used on the market. The device should include a method for Relocating waste as well as providing a means for venting the individual stalls or units. Ideally, the interior structure should be designed and configured to easily and efficiently enable cleaning and disinfecting as deemed necessary. Preferably, a water source or water supply should be included to render flushing cleansing and cleaning of one's hand after use.

The previous portable lavatories, as identified above, fail to provide the benefits intended with the present invention, such as providing a sanitary environment. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a portable sanitation device designed and configured to be a sanitary, compact and portable unit. The portable sanitation device of the present invention is structured so as to be comfortable and one like a conventional home lavatory. Thereby, rendering a final product, which allows for flushing between each use and optionally, providing the ability to wash-up by providing a water reservoir for the unit.

As such, the portable sanitation device comprises a stall unit having a portable septic tank removably secured thereto. The stall includes an interior area having at least a water flushable toilet, tissue dispensing means, and optionally a light source, vent, shower stalls interiorly and exteriorly located, diaper changing station, urinal, sanitary seat cover dispenser, moist towelett/liquid hand sanitizer/soap dispenser/sink, payable stall, and waste disposal for conventional trash.

The portable septic tank is removably secured to the under surface of the stall unit. The floor of the stall unit is angled slightly downwardly to a center point. Affixed to the center point is a drain unit. Secured above the floor is a conventional flat planar grate. The grate provides for a flat surface for the user while enabling unintentional waste or water to inherently fall between the gaps of the grates. The use of the grate provides an apparatus that is inherently easy to clean and one that allows for disinfecting the individual stall.

Located above or in close proximity to the stall unit is a detachable water reservoir. If a water source is not located on the premise, then the detachable water reservoir is removably secured to a valve/hook-up source, located exteriorly to the unit. If a water source is provided on the premise, then it is coupled to the valve/hook-up source. The water reservoir is used for flushing. In an alternative embodiment, a spray unit can be interiorly secured to the top of the individual stall and coupled to the water reservoir to allow for the water from the reservoir to be dispersed within the stall. This structure allows for the sprayer to be used for cleaning and rinsing the interior area of the stall.

A dispensing device is secured to the side wall of the individual stall. This dispensing device will house and maintain a plurality of toilet paper rolls, as well as include the option of maintaining a plurality of towellets for cleaning the user's hands. Toilet seat covers can also be located within the dispensing device.

Towellets can be eliminated by providing for the unit to be equipped with a sink. In this configuration, the sink would be coupled to the water reservoir for enabling a user to wash up. The sink can be permanently affixed or optionally hingedly secured to a side wall of the stall so as to allow for the unit to be folded and provide for more room for the user.

Optionally, various components and features can be added for enhancing the final product. One such item, which can be included, is a conventional vent. This vent can be affixed to the stall unit for permitting fumes to be redistributed to the exterior of the unit. A charcoal filter can be included in the vent to aid and assist in venting the unpleasant odors and fumes. Additionally, a light source can be interiorly and exteriorly affixed thereto for permitting more visibility. The light source and vent can be combined so as to provide for the use of a vented clear bubble light panel.

A separate urinal can also be included within the individual stall. This urinal can be coupled to the water reservoir for providing for the urinal to be flushable. In addition, the urinal can include a spray guard.

At construction sites or the like, individual shower stalls can be located within the individual stalls, or optionally exteriorly. In this configuration, the user can easily and adequately clean and rinse, which is often desirable and needed. Especially in construction situations when working with materials known for producing high volume of dust, such as installing/removing dry wall, installing/removing installation, during residential and commercial demolition projects, removing asbestos, or the like. The use of the shower can be an added health benefit to those who chose to use the apparatus of the present invention.

Power, if needed, can be supplied via conventional means or optionally can be supplied by the use of a solar unit. This solar unit will ultimately provide for a compact unit that is easy to install and one, which does not have any obtrusive cables or the like, secured thereto.

In addition, a capacity gage can be located o the septic tank for monitoring the waste located therein. Further, the drain pipes for the urinal and sink can be coupled via an S-trap. The use of the S-trap will eliminate the possibility of odor.

Further, a by-pass valve can be coupled to the inlet of the septic tank. Piping or the like can be coupled to the by-pass valve and tapped into an existing sewer line. This will enable the waste to by-pass the septic tank and go directly into the existing sewer line.

Accordingly, it is the object of the present invention to provide for a portable sanitation device that will overcome the deficiencies, shortcomings, and drawbacks of prior sanitation devices and methods thereof. over the deficiencies, shortcomings, and drawbacks of prior sanitation device and methods thereof.

Another object of the present invention is to provide for an environmentally friendly portable lavatory, which includes a separate and removably septic tank, and one that enables flushing between use.

Still another object of the present invention, to be specifically enumerated herein, is to provide a portable sanitation device in accordance with the preceding objects and which will conform to conventional forms of manufacture, be of simple construction and easy to use so as to provide a device that would be economically feasible, long lasting and relatively trouble free in operation.

Although there have been many inventions related to sanitation device, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
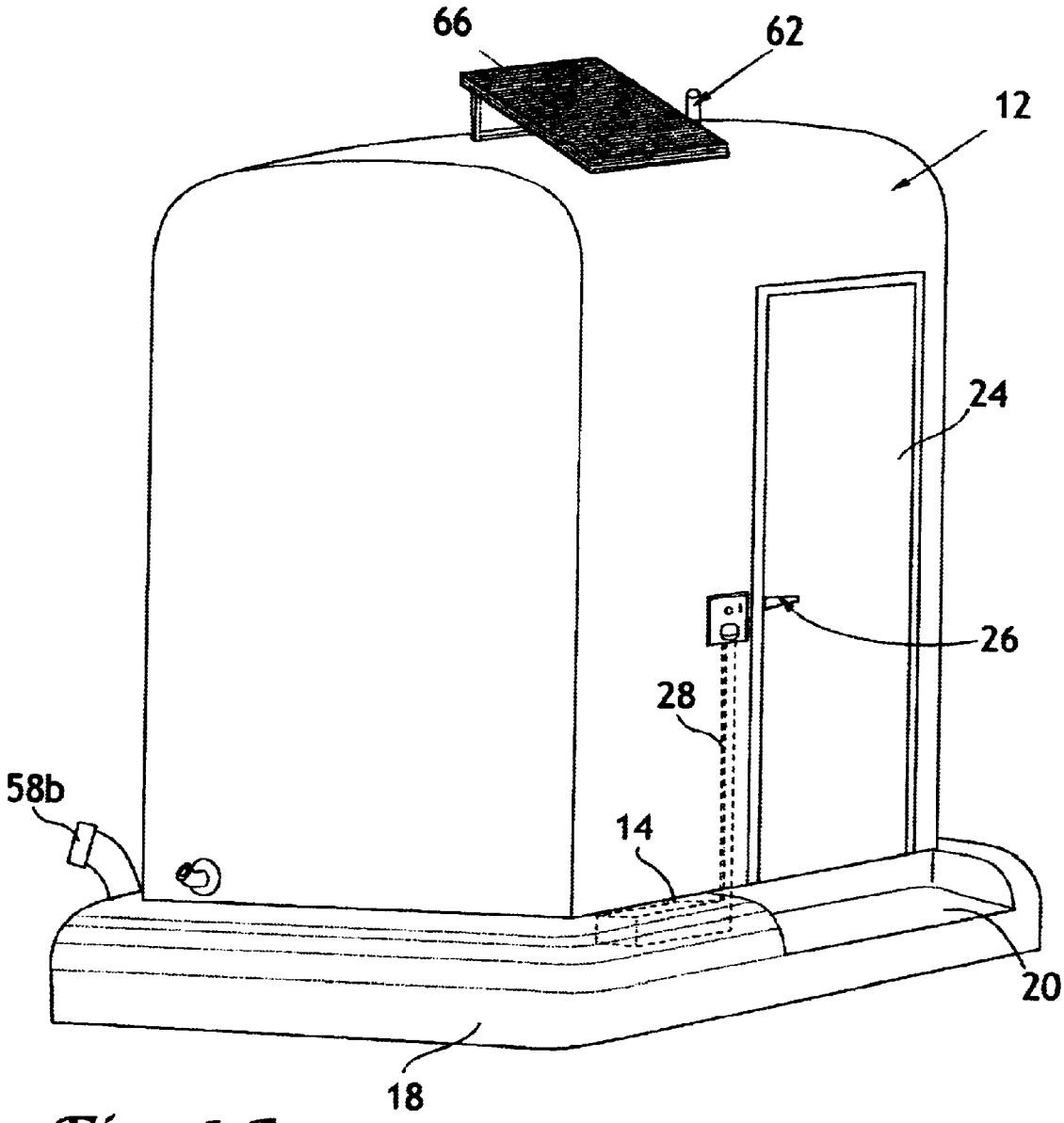
FIG. 1*a* is a front planar view of the portable laboratory apparatus of the present invention.
Figure 1B:
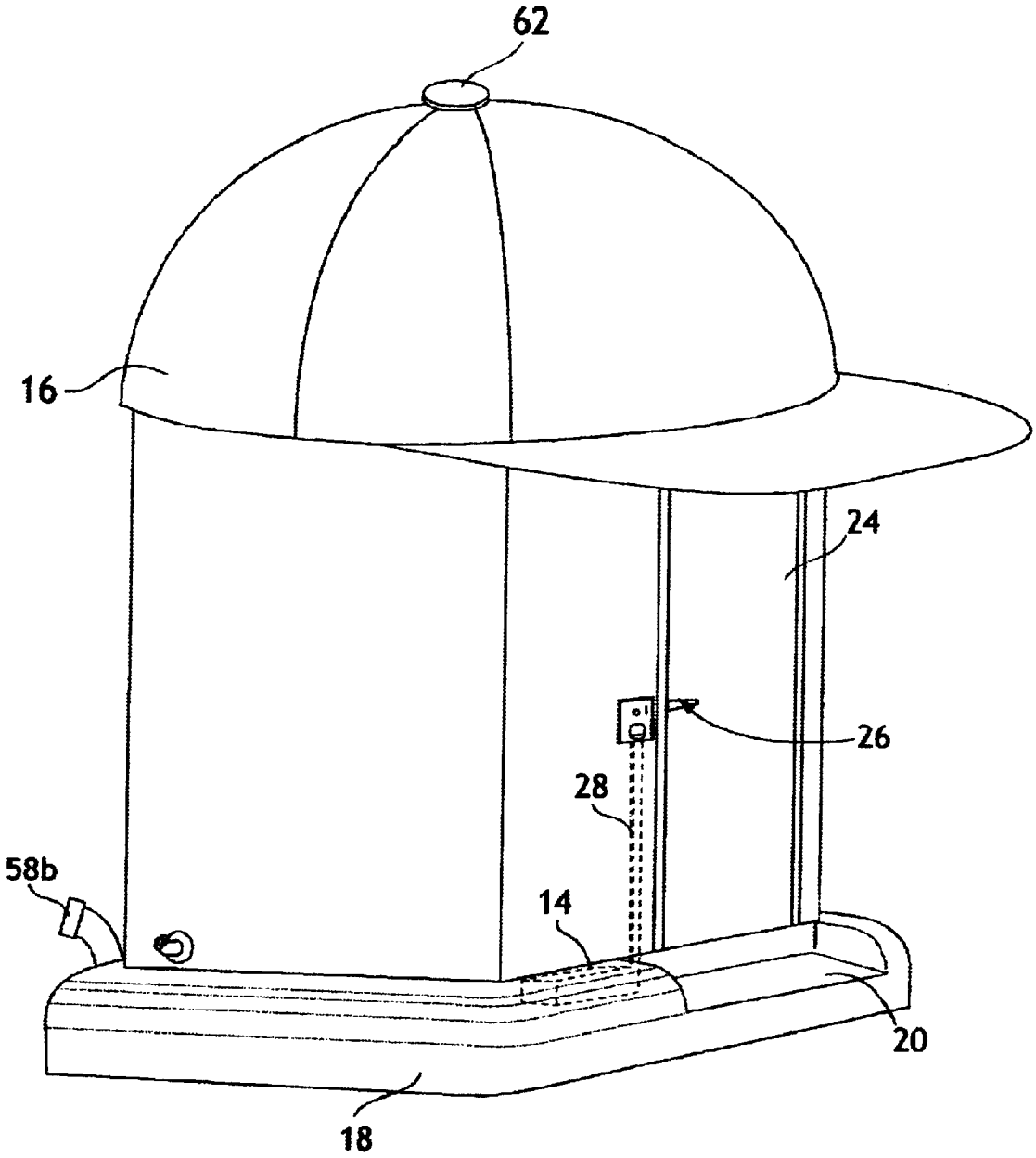
FIG. 1*b* is a front planar view of the portable laboratory apparatus of the present invention, having an altered top secured thereto.
Figure 2:
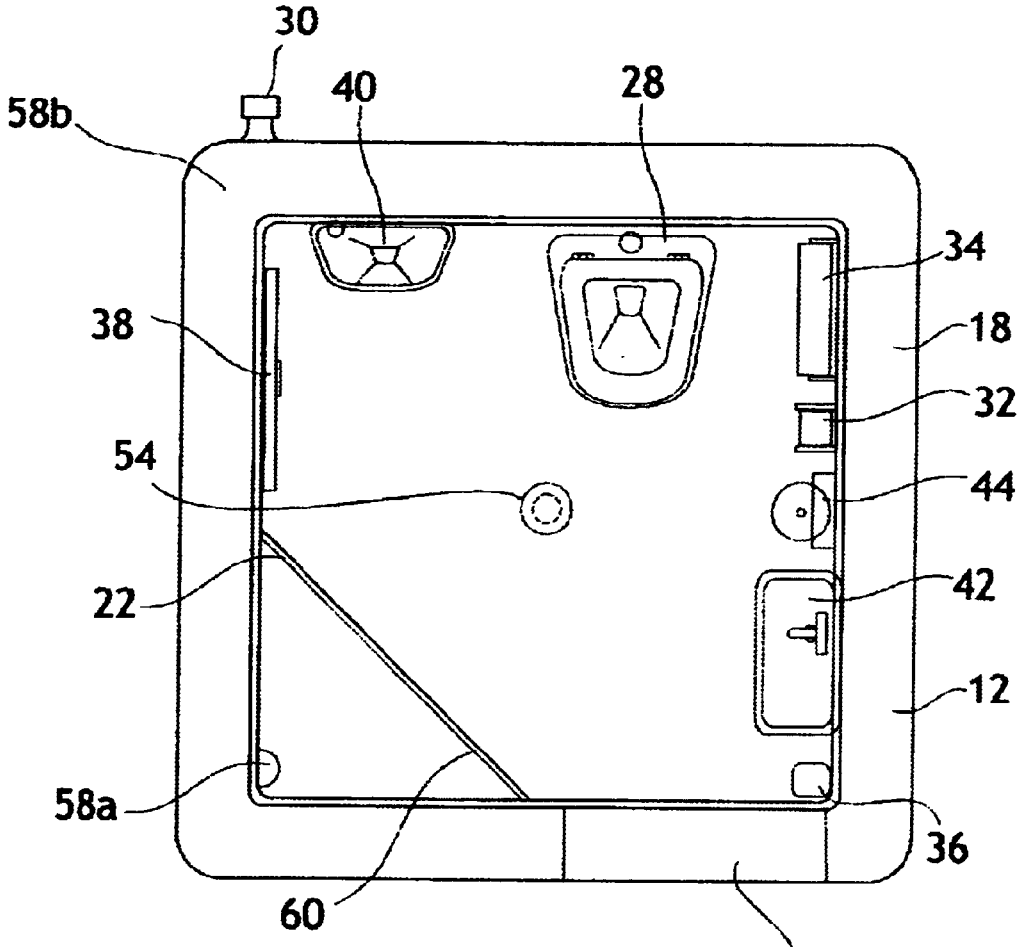
FIG. 2 is a top planar view illustrating the components used with the portable laboratory apparatus of the present invention.

As seen in the drawings, in particular FIGS. 1*a*–2 there is shown the present invention 10, which is portable laboratory apparatus, known in the industry as a port-a-potty. This portable sanitation device of the present invention is structured so as be comfortable and sanitary, so as to provide a device which is demanded by the consumers, and which is environmentally safe and one which is more like a conventional home lavatory.

As seen in FIGS. 1*a*–2, the portable sanitation device 10 comprises a stall unit 12 having a portable septic tank 14 (illustrated in outline in FIG. 1*a*) secured thereto. The septic tank can include a drain, illustrated in outlined, but not labeled, for enabling draining and removal of the waste located therein. This drain and draining system is generally associated with septic tanks used with recreational vehicles (RVs). Hence, the removal of waste is done expeditiously and successfully, using conventional means available, thereby avoiding additional costs by not requiring special equipment to be made for cleaning and removing the wastes from the tank. Optionally, secured to the septic tank is a capacity gage. This will alert the user when the tank is full so as to allow for proper disposal of waste.

The exterior of the stall unit 12 can have a conventional appearance, as shown in FIG. 1*a* or optionally can include a unique top 16 which is geared and designed towards the particular public event. By way of example, as seen in this figure, the top 16 is shaped as a baseball cap. This top 16 can have any design or shape as deemed appropriate by the buyer/renter/consumer. In addition, if using a unique top, such as a cap, an inherent enlarged top will be formed. Thereto, this is an ideal enlarged storage area. Mechanical or electrical features can be stored and housed within this top and can even maintain water so as to allow for the top to be used as a reservoir for water.

The apparatus 10 of the present invention houses the septic tank 14 within a platform 18. This platform consequently causes the stall 12 to be slightly above ground level, thus, enhancing ease of entrance and exit from the stall. A step or steps 20 can also be provided.

Figure 6:
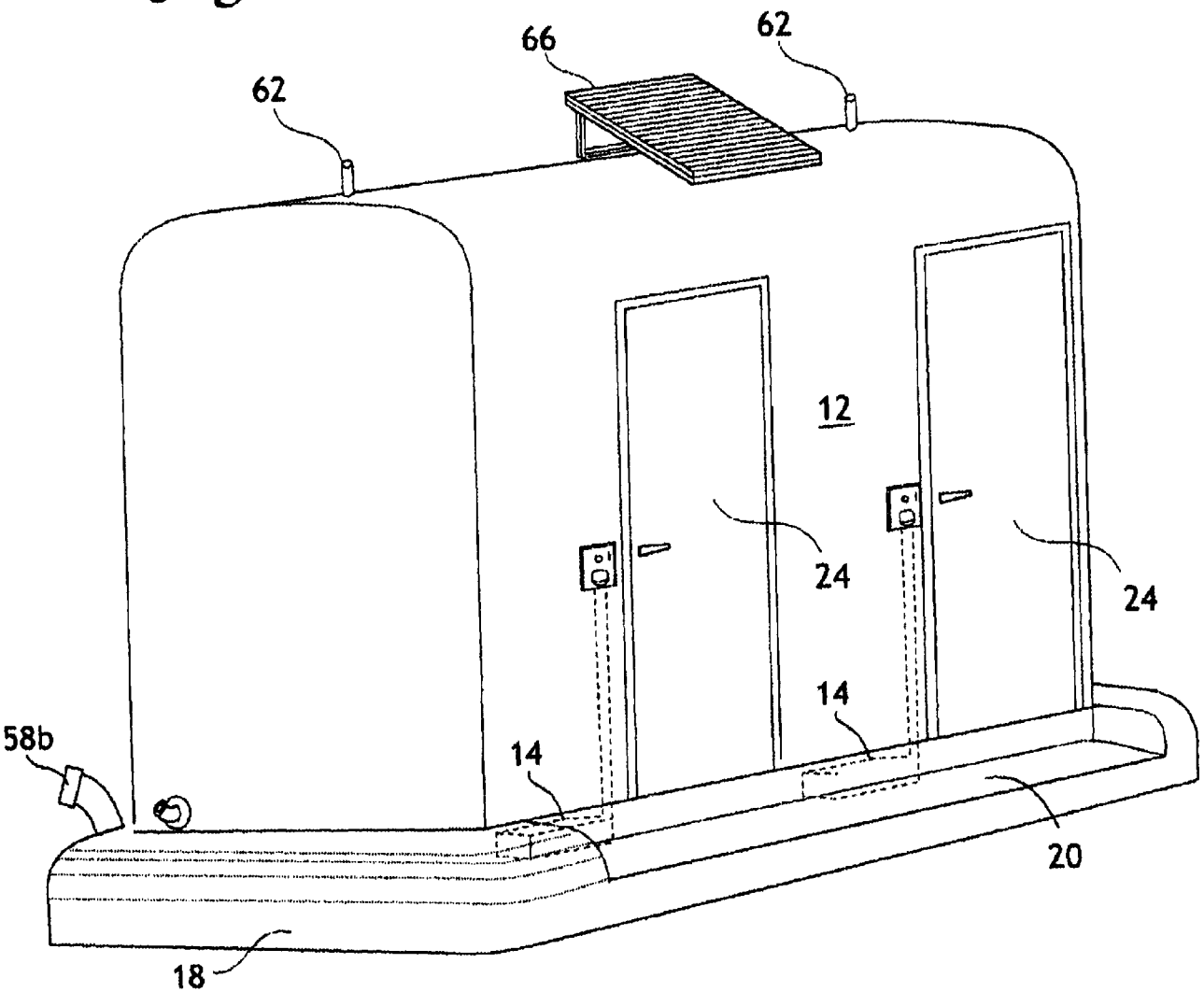
FIG. 6 is a perspective view illustrating a series of portable laboratories of the present invention.

The stall unit 12 includes an interior area 22, as seen in FIG. 2, which is accessible via a conventional door 24, illustrated in FIGS. 1*a* and 1*b*. The door 24 is lockable via the use of a conventional lock. Optionally, and as seen in FIG. 1*b*, a monetary locking unit 26 can be used to access the interior area of the stall unit 12. In this arrangement, coins or tokens are inserted into a conventional monetary locking system 26 so as to permit the door to unlock and open, and to allow access interiorly. The coin/token lock box, the receptacle which receives and maintains the coins/tokens, can be located and secured to the interior of the door or optionally can be located within the septic tank or in proximity thereof for security purposes. Location within or in proximity to the septic tank will deter thieves or the like from stealing and removing the coin/token receptacle. In the latter arrangement, a duct or the like, will be located within the walls of the stall 12 and extend through the floor and to the holding receptacle. The holding receptacle is accessible via a lock door located on the exterior of the device. In the preferred embodiment, the septic tank will include an interior flange or edge portion. This interior flange or edge portion will be located above the waste and hence, will allow for the receptacle to be secured thereto. This will prevent the receptacle from contacting the waste within the septic tank. The lockable access door is exteriorly located in front of the receptacle. This will allow for the one to easily collect the coins/tokens from the receptacle by unlocking the door for accessing the box. An example of the door 56 is illustrated in FIG. 6.

As seen in FIG. 2, the interior area 22 houses at least a flushable toilet 28. This is a conventional toilet 28 and for conservation of water, can be a low flow model. In addition, for adding to the sanitation of the device, the unit can be flushable via a conventional sensing unit. This flushable toilet 28 is coupled to a water source via hook-up service 30. The flushing system is conventional and well known. When the toilet flushes, the waste and water will be transported to the waste tank 14 located within the platform 18 of the stall 12. Industrial conventional toilets are known and widely used in commercial settings, such as in department stores, restaurants, airports and the like. These types of toilets will be used with the apparatus of the present invention and thus, since commercially available, need not be discussed in further detail.

Optionally, the toilet can be coupled to an existing sewage line. In this arrangement, the line coupled to the toilet would tapped to the existing sewage line used within the particular area, such as the sewage line used within city limits. To provide for such a configuration, a by-pass valve would be located at the inlet of the septic tank. This would allow for piping or the like to be coupled to the valve and provide for the passage to the septic tank to be in a closed position. Passage to the piping would be in an open position and thus render the waste to by-pass the septic tank and travel to the existing sewage line.

Located in proximity to the flushable toilet 28 is a conventional tissue dispensing device 32. Preferably this tissue dispensing device will house a plurality of rolls of toilet or optionally, will house and maintain a industrial roll of toilet paper. This conventional tissue dispensing device will be permanently affixed to the side wall of the stall. Access to the interior can be accomplished via a hinged door or the like, for replace and refurbishing additional rolls. The tissue dispensing device is conventional and well known.

Other conventional items can be located within the interior 22 of the stall 12 for further enhancing the final product. One item that can be installed is a sanitary seat cover dispensing device 34, a trash receptacle 36, and a diaper changing station 38. These items listed above would be permanently affixed to the side wall of the stall 12. This will prevent thief and vandalism as well as prevent accidental removal and displacement during the transportation of the stall unit of the present invention. The diaper changing station is preferably foldable so as to provide for the unit to be in folded position when not in use and to optimize space within the stall.

Yet another feature which can be added and be beneficial to the portable sanitation device of the present invention is an urinal 40. The urinal is tapped to the same water line as the toilet and its operation is conventional.

Tapping into the same water line is a sink 42. Located in proximity to the sink would be a soap dispensing device. Optionally, this sink can be eliminated and an apparatus dispensing moist toweletts 44 can be secured to the side wall of the stall. The sink or moist toweletts offer the user a means of washing and cleaning their hands, something that is not only desirable, but also a necessity when using a laboratory. The sink can be hingedly secured to the wall of the stall for providing for the sink to fold when not in use.

It is noted that the piping between the sink and urinal can each include a S-trap so as to eliminate odor. Optionally, the piping between the sink and urinal can be coupled and thus one S-trap can be used between the two units.

Figure 3:
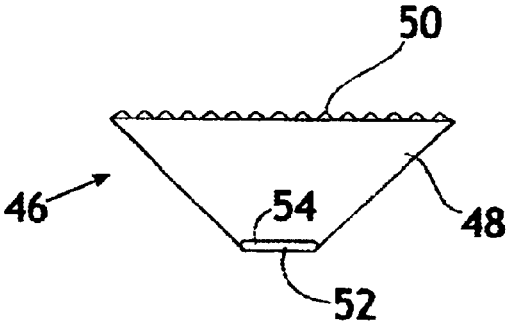
FIG. 3 is a front planar view of the floor used with the portable laboratory apparatus of the present invention.

The floor includes a unique design and configuration for enabling easy cleaning of the interior stall of the present invention. As seen in FIGS. 2 and 3, the floor 46 comprises a lower portion 48 and a top grated portion 50. The lower portion 48 is constructed from a durable material, preferable from the same material as the walls of the stall 12. As seen, this lower portion 48 of the floor 46 of the stall unit is angled slightly downwardly to a center point 52. Affixed to the center point 52 is a drain unit 54. Secured above the lower portion 48 is a conventional flat planar grate. The grate constitutes the top portion and provides for a flat surface for the user while enabling unintentional waste or water to inherently fall between the gaps of the grates for disposal via the drain. The use of the grate provides an apparatus, which is inherently easy to clean, and one that allows for disinfecting the individual stall. During cleaning the conventional drain 54 is open or may be opened to allow for the water to escape from the interior. Piping or the like can be coupled to the drain 54 for allowing for the water to flow to desired location for disposal.

In an optional design, the floor can be flat and linear. This flat and linear floor is preferable fabricated from an anti-skid material so as to prevent slippage or the like should the floor be moist or wet. A drain, as disclosed above, can be located within the floor so as to enable efficient draining thereto.

Another beneficial feature, as seen in FIG. 2, which can be included in the portable laboratory of the present invention is a shower head 58*a*, located interiorly, shower head 58*b*, located exteriorly, or both shower heads 58*a* and 58*b*, located interiorly as well as exteriorly. In any of the configuration, the shower heads will be tapped to the same water line. The use of shower heads can be beneficial to those at the beach, camping sites, or in the construction industry, where dust and debris is common. Having shower heads will provide the user and/or worker with the option of cleaning and rinsing which may be desirable and, at times, a necessity, especially when working on dangerous and hazardous products, such as removing asbestos or the like. Thereby, providing a final product which can be an added health benefit to the worker by enabling immediate removal of dangerous and potentially hazardous waste products located on his skin and clothing.

If a shower head 58*a* is located within the individual stall, then a shower curtain 60 or shower curtain rod can be slidably mounted to the ceiling or walls of the unit. This will protect the paper products and other items within the individual stall.

Still another important feature that can be installed onto the portable laboratory 10 of the present invention is a vent 62, illustrated in FIGS. 1*a* and 1*b*. This vent will enable fumes and vapor (in the case of having a shower head located therein), to be distributed exteriorly. To aid in the removal of unpleasant odors, a charcoal filter can be included with the conventional vent. Thereby, producing a final product, which will adequately, and efficient relocate and re-distribute odor from the interior of the unit to the exterior.

Figure 4:
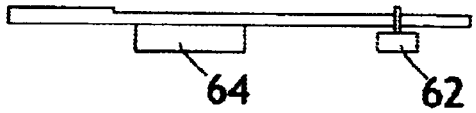
FIG. 4 is a front planar view of the ceiling used with the portable laboratory apparatus of the present invention.

For night use, the stalls can be equipped with a light source 64, as shown in FIG. 4. This light source can be activated (in the "on" position) continuously, activated manually via a switch by the user, or activated by way of locking the door. The light source can be located interiorly or optionally exteriorly. It is noted that the vent and light source can be combined to provide for the use of a vented clear bubble light panel.

Figure 9:
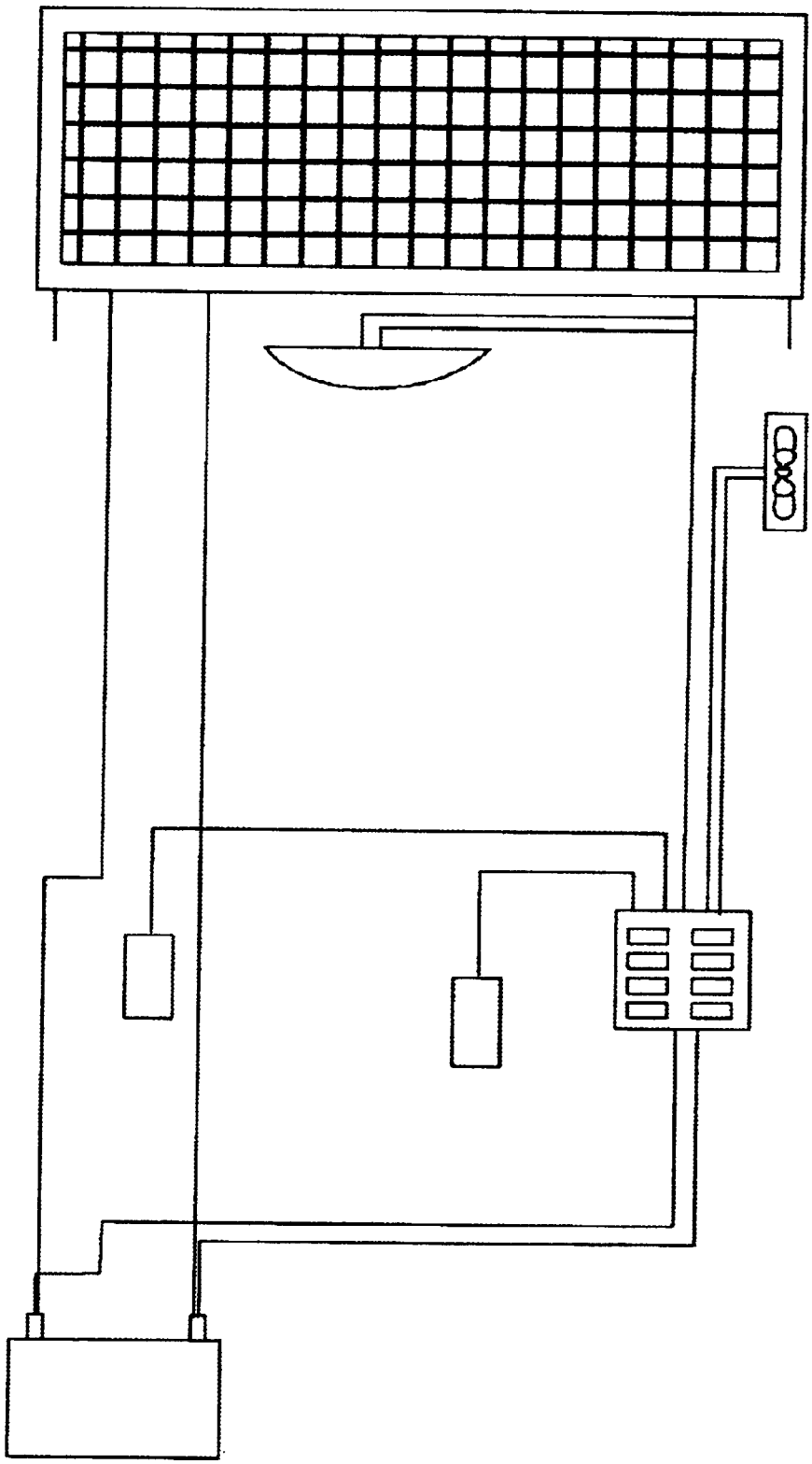
FIG. 9 is schematic view of the electrical circuit involved for adequately operating the portable laboratory apparatus of the present invention.

Power, if needed for some of the components, such as with the light source and vent, can be supplied via individual powered units. This will provide for the light source to have its own battery pack as well as provide for the vent to have its own battery pack. Optionally, power can be supplied by way of cables, which will enable the unit to be plug into the power supply at the site. Optionally, as in the preferred embodiment, power can be supplied via a solar unit 66, as illustrated in FIG. 1*a*. This will ultimately provide for a compact unit that is easy to install and one, which does not have any obtrusive cables or the like, secured thereto. The use of the solar unit will also be energy efficient and will allow for a more powerful unit and thus enable the flushable components (toilet and urinal) to be operated via a sensor. The circuitry involved for the solar unit is discussed in further detail in FIG. 9.

Figure 5A:
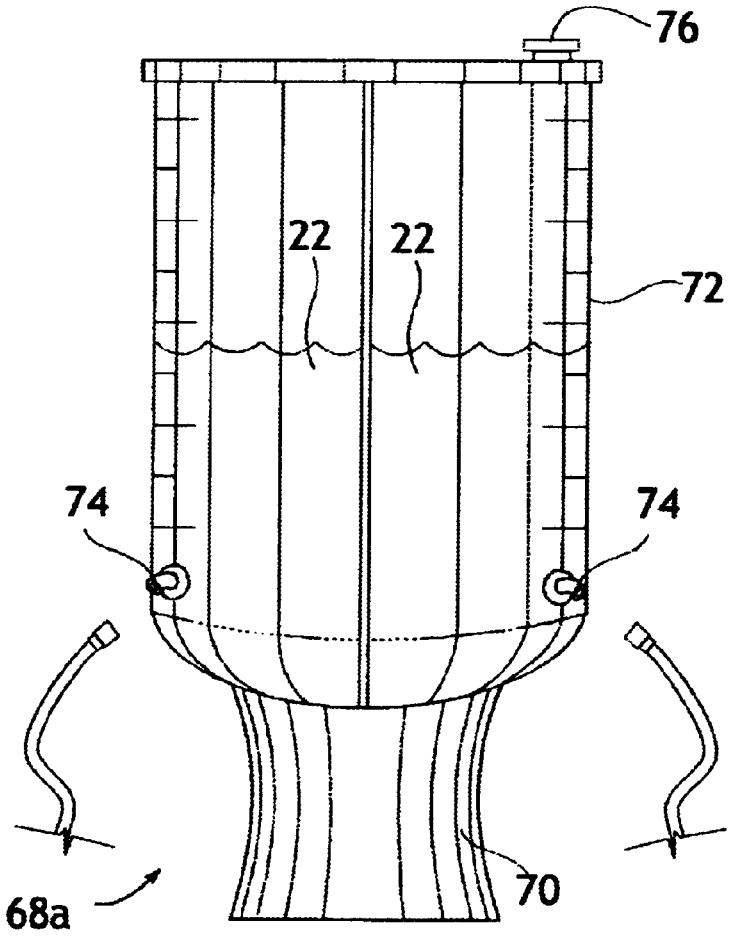
FIG. 5 is a front view of the optional detachable reservoir used with portable laboratory apparatus of the present invention.
Figure 5B:
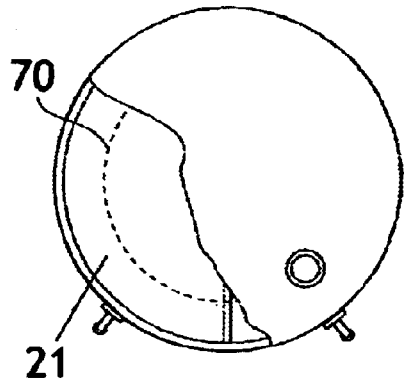

When water is not accessible on the site, a separate water source is provided. This water source is a water reservoir, which is designed, and configured to maintain high volumes of water, and thus can include any geometric structured. An example of a water reservoir or water tank 68*a* is illustrated in FIG. 5. As seen, this water tank 68*a* includes a base 70 that supports the main water reservoir 72. Located at the lower end of the main water reservoir is a coupling valve unit 74. This coupling valve unit 74 enables the present invention to be coupled thereto. Coupling can occur via a number of conventional means and methods, such as via hose, drain or the like. The top includes an inlet means 76 for enabling the reservoir to be filled with water when deemed appropriate.

Optionally, the water reservoir, can be integral with the unit, as illustrated in FIG. 1*b*. As seen in this figure, the water reservoir 68*b* is located at the top of the unit and includes an inlet means 76. This will permit for the reservoir to be filled with water as deemed necessary. In this arrangement, all piping to the desired location (i.e. toilet, urinal, sink, and the like) is accomplished via the walls of the individual stall. This will produce a final product, which is compact and does not require the assistance of any other sources for successful operation.

The portable laboratory of the present invention can be sold as an individual stall, as illustrated in FIG. 1*a* or optionally can be coupled to one another to provide for a series of laboratories to exists. An example of this arrangement is illustrated in FIG. 6. As seen in this figure, a series of laboratories 10 are situate. Each stall includes the vent 62. A singular solar unit 66 can be used to power the series of laboratories as illustrated. This embodiment, further illustrates that a water reservoir 68*b* is integral with the final product.

Figure 7:
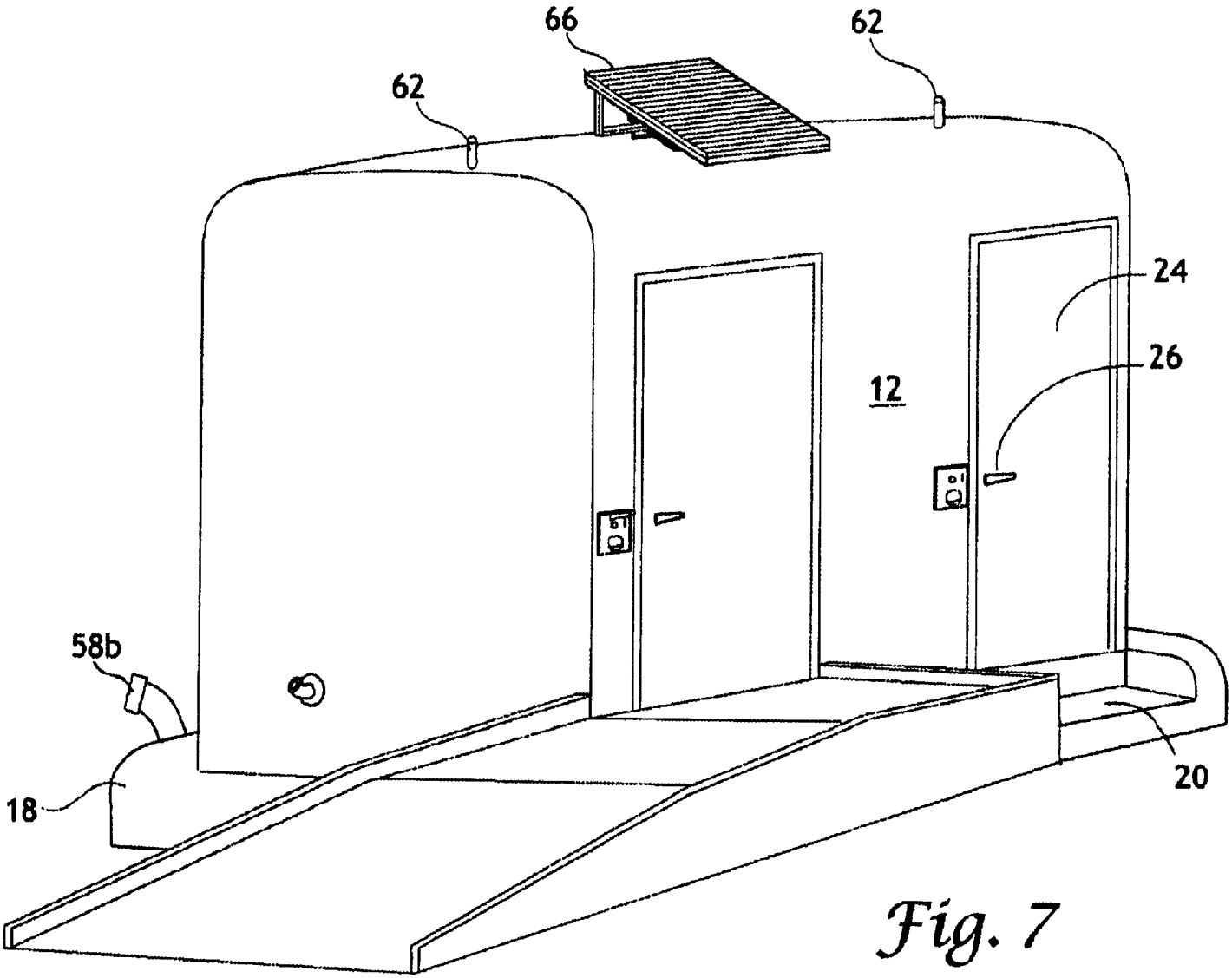
FIG. 7 is a perspective view of an alternative embodiment of the portable laboratory of the present invention designed especially for those with disabilities.
Figure 8:
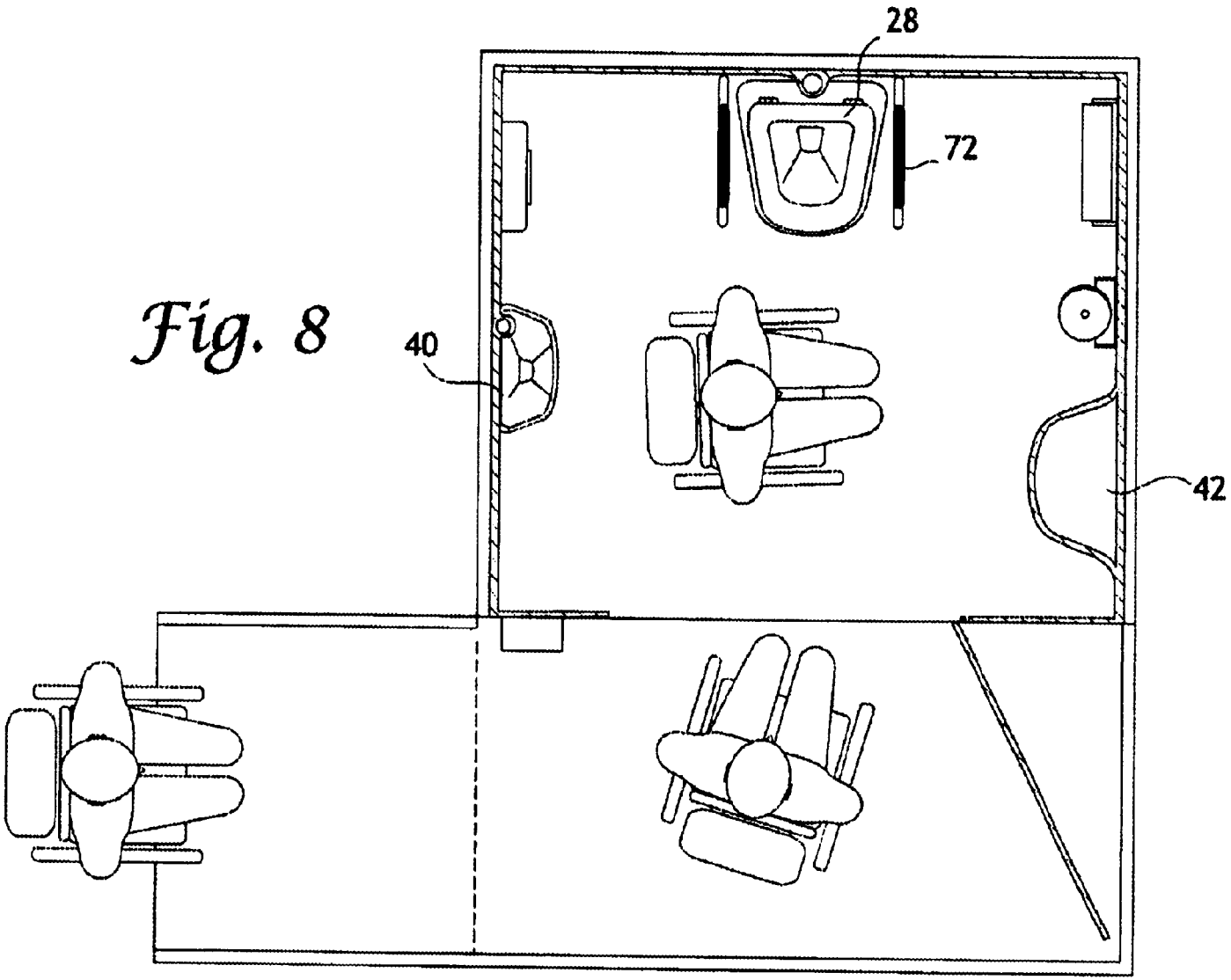
FIG. 8 is a top planar view illustrating the components used with the portable laboratory apparatus of the present invention geared and designed specifically for those with disabilities.

The present invention can be altered slightly, so as to provide for a final product that is designed specifically for those with disabilities. An example of this altered portable laboratory is illustrated in FIGS. 7 and 8. As seen in these figures, the present invention includes wheelchair accessibility by providing for the exterior of the laboratory to include a ramp 70. The ramp can include a ledge, for preventing the wheelchair from accidentally falling from the ramp. The use of the ledge is a safety feature, which can be advantageous. The ramp can further include a landing, which will aid in entering the stall.

The interior 22 of the stall can include all the items as identified above, and as illustrated in FIG. 8. Some of the components, such as the toilet 28, urinal 40, and sink 42 will be sized appropriately, so as to offer the optimum convenience to those who must occupy a wheelchair. The toilet can also include guard rails 72.

The flooring in this embodiment will not be grated, but rather, will be solid, flat and planar. In addition sufficient clearance will be provided so as to enable a wheelchair to easily rotate complete within the individual stall. Due to this increased size, it may be advantageous to include the diaper changing station in this type of stall.

During utilization, a single stall can be used or the handicapped stall can be coupled to other individual stalls, such as to one not having features geared towards those with disabilities. This arrangement is illustrated in FIG. 7, and as seen illustrates a non-handicapped stall coupled to a stall geared towards those with disabilities.

It is further noted that the portable toilet, as illustrated throughout the drawings, can be coupled together, in any number, or any arrangement so as to provide for a final product, which is suitable for any and all environments. Such a feature will allow for non-disability stalls to be used solely or in combination with stalls geared towards those with disabilities. In addition disability stalls can be used solely or in combination with stalls geared towards those without disabilities.

In the preferred embodiment, the stalls of the present invention is fabricated from a durable and non-erosive material that can easily and effectively be sanitized. Once such material that has been utilized to produce favorable results is Nupro™. Other polymeric material, metals, polymer coated metals or the like can be utilized for the stall and its components.

While the invention has been particularly shown and described with reference to an embodiment thereof, it will be understood by those skilled in the art that various changes in form and detail may be made without departing from the spirit and scope of the invention.

We claim:

1. A portable sanitation device comprising:

a platform;

a stall unit mounted on said platform;

a flushable toilet being located within said stall unit;

a water source including a water reservoir being coupled to said stall unit and said toilet for enabling said toilet to have flushing capabilities via said water source;

a portable septic tank located in said platform and being coupled to said flushable toilet;

an entry door located on said stall, said entry door having a monetary locking device for accepting coins or tokens to gain entry to said stall, a coin/token lock box located in said septic tank for receiving coins or tokens used to enter said stall by said monetary locking system.

2. A portable toilet system as in claim 1 wherein a shower head is located exteriorly to said stall and said shower head is coupled to said water source.

3. A portable sanitation device as in claim 1 wherein a tissue dispensing device is located in proximity to said toilet.

4. A portable sanitation device as in claim 1 wherein a diaper changing station is located within said stall.

5. A portable sanitation device as in claim 1 wherein a urinal is located in said stall and said urinal is coupled to said septic tank.

6. A portable sanitation device as in claim 5 wherein said urinal is coupled to said water source for enabling said urinal to include flushing capabilities and said urinal is coupled to said septic tank for enabling waste from said urinal to travel to said septic tank.

7. A portable sanitation device as in claim 1 wherein a trash receptacle is located within said stall.

8. A portable sanitation device as in claim 1 wherein a sink is located within said stall and said sink is coupled to said water source and said sink is coupled to said septic tank for enabling spent fluid to travel to said septic tank.

9. A portable sanitation device as in claim 1 wherein a dispensing apparatus adapted to dispense moist toweletts is located within said stall.

10. A portable sanitation device as in claim 1 wherein said stall includes a grated floor portion, located below said grated floor portion is an angled lower floor area that includes a drain.

11. A portable sanitation device as in claim 1 wherein a showerhead is located within said stall and said showerhead is coupled to said water source.

12. A portable sanitation device as in claim 1 wherein a ramp is exteriorly coupled to said stall for enabling wheel chair accessibility.

13. A portable sanitation device as in claim 1 wherein a light source is interiorly located within said stall.

14. A portable sanitation device as in claim 1 wherein a light source is exteriorly located to said stall.

* * * * *